US008020509B2

(12) United States Patent
Calla et al.

(10) Patent No.: US 8,020,509 B2
(45) Date of Patent: Sep. 20, 2011

(54) APPARATUS, SYSTEMS, AND METHODS INVOLVING COLD SPRAY COATING

(75) Inventors: Eklavya Calla, Rajasthan (IN); Marshall Gordon Jones, Scotia, NY (US)

(73) Assignee: General Electric Company, Schenectady, NY (US)

( * ) Notice: Subject to any disclaimer, the term of this patent is extended or adjusted under 35 U.S.C. 154(b) by 200 days.

(21) Appl. No.: 12/350,565

(22) Filed: Jan. 8, 2009

(65) Prior Publication Data

US 2010/0173087 A1 Jul. 8, 2010

(51) Int. Cl.

| | |
|---|---|
| ***B05C 19/00*** | (2006.01) |
| ***B05C 5/00*** | (2006.01) |
| ***B05B 5/00*** | (2006.01) |
| ***B05B 7/16*** | (2006.01) |

(52) U.S. Cl. ..... 118/308; 118/302; 118/642; 118/643; 118/58

(58) Field of Classification Search ..... 118/308, 118/302, 641–643, 663, 666, 667; 427/372.2, 427/532, 553, 180

See application file for complete search history.

(56) References Cited

U.S. PATENT DOCUMENTS

| | | | | |
|---|---|---|---|---|
| 5,302,414 | A | 4/1994 | Alkhimov et al. | |
| 5,405,660 | A * | 4/1995 | Psiuk et al. | 427/597 |
| 5,993,554 | A * | 11/1999 | Keicher et al. | 118/641 |
| 6,074,135 | A | 6/2000 | Tapphorn et al. | |
| 6,391,251 | B1 * | 5/2002 | Keicher et al. | 419/7 |
| 7,661,387 | B2 * | 2/2010 | Poullos | 118/667 |
| 2005/0233090 | A1 | 10/2005 | Tapphorn et al. | |
| 2006/0133947 | A1 | 6/2006 | DeBiccari et al. | |
| 2006/0260126 | A1 | 11/2006 | Groh et al. | |
| 2010/0098845 | A1 * | 4/2010 | Jensen et al. | 427/185 |

FOREIGN PATENT DOCUMENTS

| | | | |
|---|---|---|---|
| EP | 1439239 | A1 | 7/2004 |
| EP | 1535692 | A1 | 6/2005 |
| EP | 1674596 | A1 | 6/2006 |
| EP | 1728881 | A2 | 12/2006 |
| GB | 2439934 | A * | 1/2008 |
| WO | 02085532 | A1 | 10/2002 |
| WO | 2006082170 | A1 | 8/2006 |
| WO | 2007000422 | A2 | 1/2007 |

OTHER PUBLICATIONS

EP Search Report for EP Application No. 09180172.0; mailing date Mar. 25, 2010.

* cited by examiner

*Primary Examiner* — Yewebdar Tadesse
(74) *Attorney, Agent, or Firm* — Cantor Colburn LLP

(57) ABSTRACT

A cold spray coating system comprising, a cold spray coating gun having a nozzle member operative to emit a stream of gas and granules of a coating material from a nozzle opening defined by the nozzle member such that the granules of the coating material impact and bond with a first region of a substrate, and a heat source member operative heat the first region of the substrate.

12 Claims, 3 Drawing Sheets

APPARATUS, SYSTEMS, AND METHODS INVOLVING COLD SPRAY COATING

BACKGROUND OF THE INVENTION

Cold spray coating systems and methods are used to apply various types of coatings to a substrate object. For example, a steel mechanical component may be coated with a protective layer of material to prevent corrosion of the mechanical component.

Cold spray methods use a spray gun that receives a high pressure gas such as, for example, helium, nitrogen, and air, and a coating material, such as, for example, metals, refractory metals, alloys, and composite materials in powder form. The powder granules are introduced at a high pressure into a gas stream in the spray gun and emitted from a nozzle. The gas stream velocity may be supersonic. The particles are accelertaed to a high velocity in the gas stream that may reach a supersonic velocity.

The powder impacts the substrate at a high velocity. The kenetic energy of the powder causes the powder granules to deform and flatten on impact with the substrate. The flattening promotes a metallurgical, mechanical, or combination of metallurgical and mechanical bond with the substrate and results in a protective coating on the substrate. One advantage of cold spraying methods is the negligible to nil phase change or oxidation of particles during flight and high adhesion strength of the bonded particles.

Some substrates are treated with heat after the application of the coating. The heat treatment may include, for example, placing the substrate in an oven or furnace for annealing. The step of annealing the coated substrate increases the complexity of the process, the duration of the process, and uses additional industrial resources and energy.

Thus, a method, system, and apparatus that simplifies applying cold spray coatings and increases the efficiency of applying cold spray coatings is desirable.

BRIEF DESCRIPTION OF THE INVENTION

An exemplary embodiment includes a cold spray coating gun for applying a material coating to a substrate comprising, a heating member operative to heat a first region of the substrate. The embodiment further including a nozzle member operative to emit a stream of gas and granules of a coating material from a nozzle opening defined by the nozzle member such that the granules of the coating material impact and bond with the first region of the substrate.

An exemplary embodiment of a cold spray coating system comprising, a cold spray coating gun having a nozzle member operative to emit a stream of gas and granules of a coating material from a nozzle opening defined by the nozzle member such that the granules of the coating material impact and bond with a first region of a substrate, and heat source member operative to heat the first region of the substrate.

An exemplary method for cold spray coating a substrate, the method comprising, applying a coating material to a first region of the substrate with a cold spray coating system, heating the coated first region of the substrate.

BRIEF DESCRIPTION OF THE DRAWINGS

These and other features, aspects, and advantages will become better understood when the following detailed description is read with reference to the accompanying drawings in which like characters represent like parts throughout the drawings, wherein.

DETAILED DESCRIPTION OF THE INVENTION

In the following detailed description, numerous specific details are set forth in order to provide a thorough understanding of various embodiments. However, those skilled in the art will understand that the embodiments may be practiced without these specific details, that the embodiments are not limited to the depicted embodiments, and that the embodiments may be practiced in a variety of alternative embodiments. In other instances, well known methods, procedures, and components have not been described in detail.

Further, various operations may be described as multiple discrete steps performed in a manner that is helpful for understanding the embodiments. However, the order of description should not be construed as to imply that these operations need be performed in the order they are presented, or that they are even order dependent. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

Figure 1:
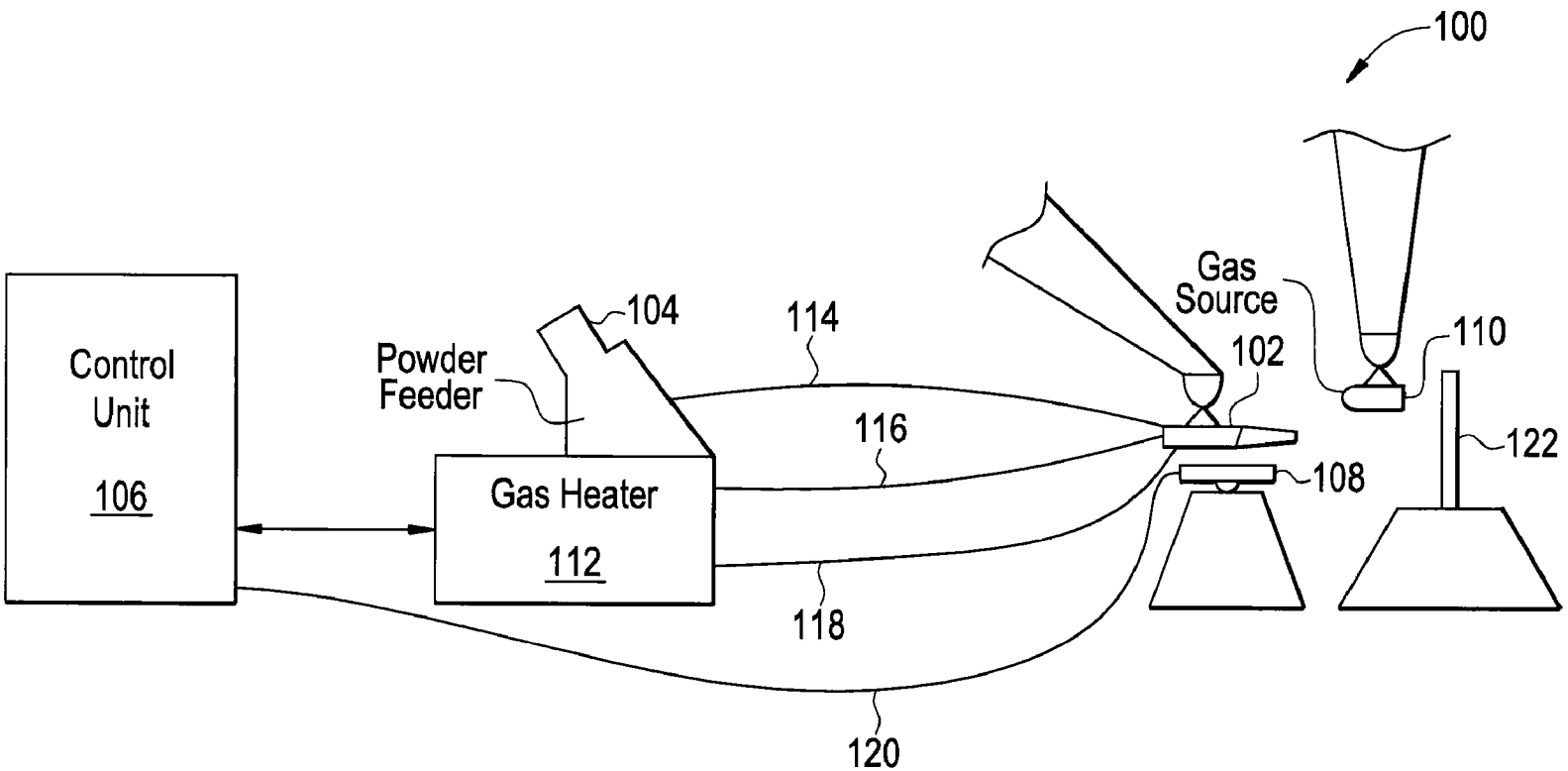
FIG. 1 illustrates an exemplary embodiment of a cold spray system.

Cold spray coating systems use a cold spray gun to apply a coating to a surface of an object (substrate). FIG. 1 illustrates an exemplary embodiment of a cold spray system 100. The system 100 includes a spray gun 102, a powder feeder 104, a control unit 106, and a heat source 108, such as, for example lasers and heating elements. The system 100 may also include a gas envelope housing member 110 and a gas heater 112. The spray gun 102 is connected to the powder feeder 104 via a powder line 114, and is connected to the gas heater 112 via a gas line 116. A sensor line 118 may communicatively connect temperature and pressure sensors (not shown) in the spray gun 102 to the control unit 106. Control lines 120 may communicatively connect the control unit 106 to the gas heater 112, the powder feeder 104, the heat source 108, and the sensors in the spray gun 102. A gas source may be connected to the gas envelope housing member 110.

In operation, the spray gun 102 receives pressurized gas from a gas source via the gas heater 112. The gas heater 112 heats the gas to increase the speed of sound in the gas. In alternate embodiments, the gas heater 112 may be bypassed and the pressurized gas is not heated. Powderized coating material is supplied under pressure to the spray gun 102 via the powder line 114. The coating material is introduced into a stream of gas internally in the spray gun 102. The coating material may be fed in a convergent or divergent region of the spray gun 102. The stream of expanding gas and coating material exits a divergent region of a nozzle in the spray gun 102. When the coating material impacts an object (substrate) 122, granules in the coating material flatten and deform to form a coating on the substrate 122. The control unit 106 controls the process including, for example the gas heater 112, the powder feeder 104 and receives pressure and temperature readings from the spray gun sensors.

The illustrated embodiment includes the heat source 108. The heat source 108 may include one or more lasers or other type of heat source such as, for example a heating element.

For illustrative purposes, the embodiment includes a laser unit as the heat source 108. The lasers emit a beam of laser light (not shown). The beam of laser light may be used to pre-heat a region of the substrate 122 prior to the application of the coating material. Pre-heating a region of the substrate 122 prior to the application of the coating material may be desirable to improve the performance and properties of the applied coating. The pre-heating may also be used to heat coated regions of the substrate prior to the application of additional coats of coating material.

The illustrated embodiment includes the heat source 108 that may use any type of laser that is suitable for heating purposes based in part on the type of coating material and the substrate that is coated. An example of a suitable laser is a diode type laser. Diode lasers emit a laser beam with a wavelength from 600 to 900 nanometers and have a suitable power density for heating ranges between $10^4$ W/cm$^2$ to $10^5$ W/cm$^2$. The shape of the laser beam may be tailored according to the width and cross-section of the coating material pattern that is emitted from the cold spray nozzle. Examples of other suitable lasers include Nd:YAG lasers and Yb doped fiber lasers having wavelengths between 600 to 1100 nanometers. When ceramic coating materials are applied $CO_2$ lasers having a wavelength of approximately 10 microns may be used.

The heat source 108 may also be used to heat a coated region of the substrate following the application of the coating material. Heating the coated region anneals the coating and may be carried out with respect to particular coating material and substrate combinations. The amount of heat imparted and the temperature achieved will depend upon particular substrate-coating combination and the resultant properties desired.

The heat source 108 may be mounted on a manipulator with the spray gun 102 or separately on another mounting apparatus. The beams from the laser unit travel on a path similar to the path traveled by the spray gun 102. Thus, as the spray gun 102 applies a coating to the substrate 122, the beams from the laser unit may proceed and/or follow the stream of coating material applied to the substrate 122.

Previous cold spray systems and methods used a furnace or oven to anneal the coating material on the substrate 122. The use of a furnace or oven resulted in a second processing step and additional equipment. Applying heat via the laser beams while the coating material is applied results in a more efficient and effective system and method. The intensity and the strength of the laser is calibrated to achieve precise heating of the substrate-coating combination according to the design specifications of the substrate and coating combination.

The gas envelope housing member 110 may be used to apply an envelope of gas around the stream of expanding gas and coating material. The envelope of gas may be desirable in some application processes to affect the oxidation of the materials. With some coating materials, such as, for example, copper, oxidation may be undesirable, and may be increased by the use of the laser beams to heat the substrate 122. An envelope of inert gas may be used to limit oxidation. In other coating materials, such as, for example, titanium, oxidation may be desirable. If oxidation is desirable, an envelope of oxygen may be used to promote oxidation. The gas envelope housing member 110 may follow a similar path as the spray gun 102 as the spray gun 102 applies coatings. The gas envelope may be used to effect the cooling of the coating/substrate after heating, if desired. This may be desirable for some applications, such as, for example, when heat sensitive materials are involved (materials that cannot withstand high temperatures for long time periods or are susceptible to rapid oxidation at high temperature).

Figure 2:
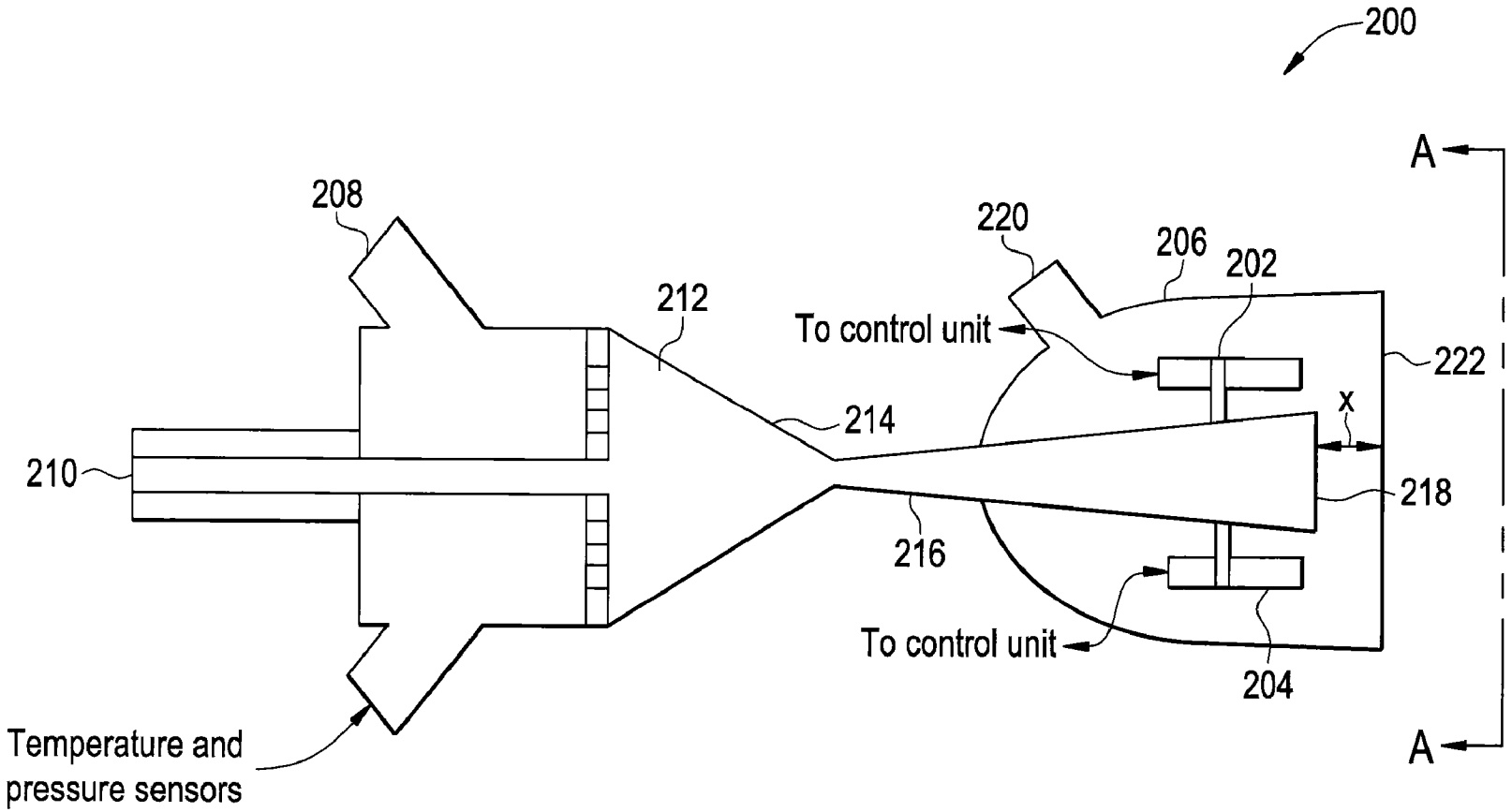
FIG. 2 illustrates a top, partially cut-away view of an exemplary embodiment of a spray gun assembly.

FIG. 2 illustrates a top, partially cut-away view of an exemplary embodiment of a spray gun assembly 200 having a nozzle 214 that includes a convergent region 212 and a divergent region 216 defined by the nozzle 214. The embodiment of the spray gun assembly 200 simplifies the system 100 described above by incorporating lasers 202 and 204 and a gas envelope housing member 206 into a single spray gun assembly. The illustrated embodiment includes two lasers 202 and 204 however; alternate embodiments may include a single laser or more than two lasers. Additional alternate embodiments of the spray gun assembly 200 may not include the gas envelope housing member 206.

Figure 3:
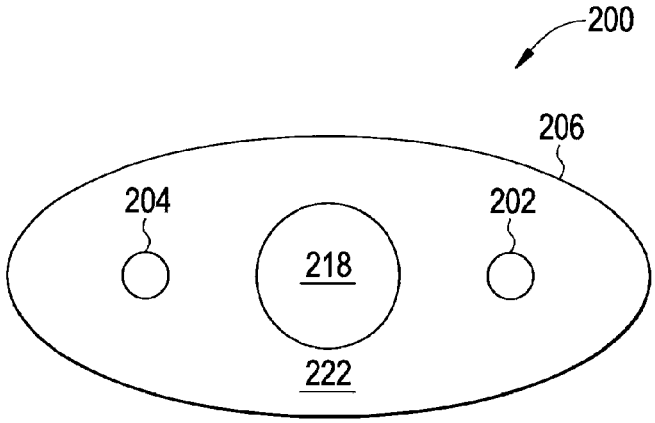
FIG. 3 illustrates a front partially cut-away view of the spray gun assembly along the line A-A of FIG. 2.

In operation, the spray gun assembly 200 receives process gas via a process inlet 208 and powderized coating material via a powder inlet 210. The coating material is introduced to the process gas in the convergent region 112. However, in alternate embodiments, the powder may be introduced in the divergent region 216. The coating material and the process gas exit the nozzle 214 from an exit opening 218 at an end of the divergent region 216. The lasers 202 and 204 are in the illustrated embodiment mounted to the nozzle 214 however; in alternate embodiments, the lasers 202 and 204 may be mounted to other portions of the spray gun assembly 200 or mounted separately from the cold spray gun assembly 200. The lasers 202 and 204 are communicatively connected to the control unit 106. In alternate embodiments the lasers and the gas envelope system 206 may include a separate control unit. The spray gun assembly 202 includes the gas envelope housing member 206 that is mounted to the nozzle 214. In alternate embodiments, the gas envelope housing member 206 may be mounted to other portions of the spray gun assembly 200. The gas envelope housing member 206 includes a first opening 220 that receives pressurized gas. The pressurized gas exits the gas envelope housing member 206 via a second opening 222. An offset distance (x) is defined by the exit opening 218 at an end of the divergent region 216 and the second opening 222 of the gas envelope housing member 206. The distance (x) may, in some embodiments be adjusted to more effectively employ the gas envelope housing member 206. FIG. 3 illustrates a front partially cut-away view of the spray gun assembly 200 along the line A-A (of FIG. 2) including the first and second lasers 202 and 204, the exit opening 218 at an end of the divergent region 216, and the second opening 222 of the gas envelope housing member 206.

Figure 4:
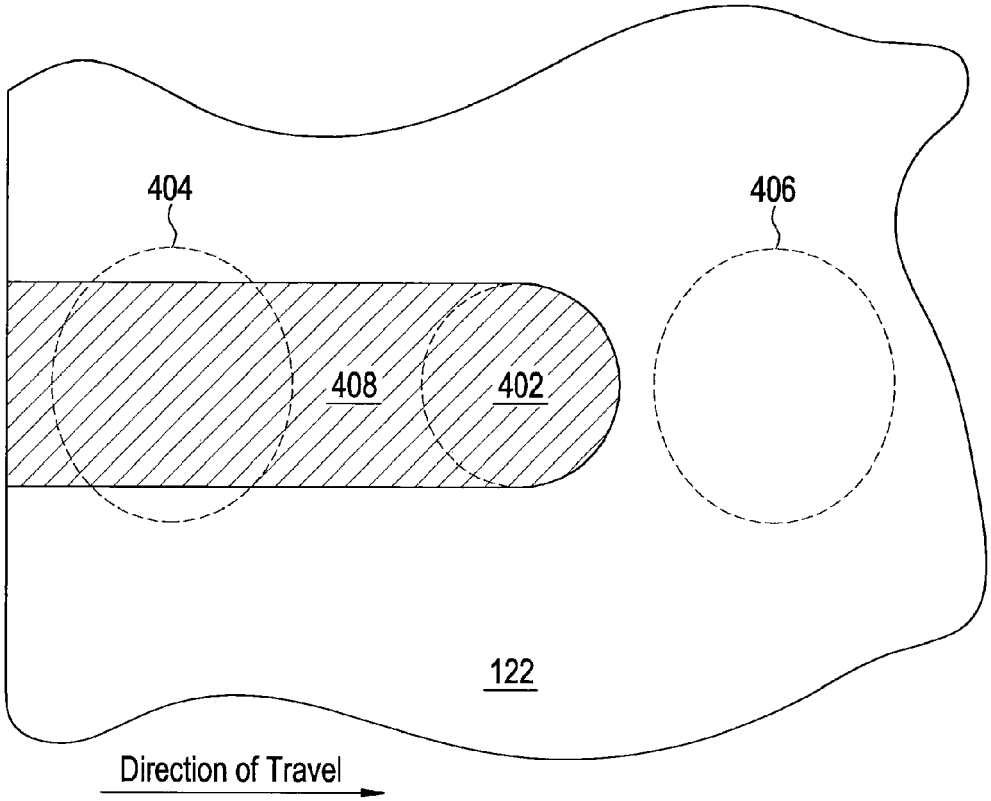
FIG. 4 illustrates an exemplary cold spray method using the cold spray gun assembly.

FIG. 4 illustrates an exemplary cold spray method using the cold spray gun assembly 200. FIG. 4 includes a portion of the substrate 122. A first laser beam in a first region 406, a spray pattern 402 emitted from the spray gun 102, a coated region 408, and a second laser beam in a second region 404. As the system 100 travels from left to right, a first laser beam heats the first region of the substrate 406, preparing the substrate for a coating material. The spray pattern 402 follows the first laser beam and applies a coating material to the substrate 122. A second laser beam heats the coated region 408, annealing the coating material. The pattern, intensity and distance of the laser beams from the a spray pattern 402 may be adjusted to effectively apply the coating material depending on factors such as, for example, the coating material used and the substrate material used in the process. The pattern 402 may be circular, rectangular or any other cross-section as may be desired. The circular cross-section is shown for illustration purposes.

The method illustrated in FIG. 4 is not limited to using two lasers, but may be implemented with an alternate combination of lasers. The illustrated method is not limited to both pre-heating the substrate prior to applying the coating material, and annealing the coating material, and may include the pre-heating process and annealing process alone or in combination. The gas envelope housing member 206 may also be used to affect the oxidation of the materials by emitting a gas when desired. Other embodiments may use other heating sources to heat the regions 406 and 404 above. Thus, the method illustrated in FIG. 4 is not limited to lasers as heat sources, but may also use other types of heat sources.

This written description uses examples to disclose the embodiments, including the best mode, and also to enable practice of the embodiments, including making and using any devices or systems and performing any incorporated methods. The patentable scope of the embodiments is defined by the claims, and may include other examples. Such other examples are intended to be within the scope of the claims if they have structural elements that do not differ from the literal language of the claims, or if they include equivalent structural elements with insubstantial differences from the literal languages of the claims.

The invention claimed is:

1. A cold spray coating gun for applying a coating material to a substrate comprising:

a first heating member operative to heat an uncoated first region of the substrate;

a nozzle member operative to emit a stream of gas and granules of the coating material from a nozzle opening defined by the nozzle member such that the granules of the coating material impact and bond with the uncoated first region of the substrate, wherein the nozzle member is arranged with the first heating member such that the stream of gas and granules does not interact with energy emitted from the first heating member; and a second heating member operative to heat the coating material bonded with the uncoated first region of the substrate.

2. The coating gun of claim 1, wherein the first heating member is a laser.

3. The coating gun of claim 1, wherein the coating gun further comprises a housing member comprising an inner cavity operative to receive a pressurized gas in a first opening and emit an envelope of the pressurized gas from a second opening.

4. The coating gun of claim 1, wherein the nozzle member includes a divergent region disposed in an inner cavity of a housing member, wherein the inner cavity is operative to receive a pressurized gas in a first opening and emit an envelope of the pressurized gas from a second opening.

5. The coating gun of claim 1, wherein the first heating member is disposed in an inner cavity of a housing member, wherein the inner cavity is operative to receive a pressurized gas in a first opening and emit an envelope of the pressurized gas from a second opening.

6. The coating gun of claim 1, wherein the second heating member is disposed in an inner cavity of a housing member, wherein the inner cavity is operative to receive a pressurized gas in a first opening and emit an envelope of the pressurized gas from a second opening.

7. The coating gun of claim 1, wherein the stream of gas is emitted at a supersonic velocity.

8. A cold spray coating system comprising:

a cold spray coating gun having a nozzle member operative to emit a stream of gas and granules of a coating material from a nozzle opening defined by the nozzle member such that the granules of the coating material impact and bond with a first region of a substrate;

a first heat source member operative to heat the first region of the substrate, the first heat source member and the nozzle member are arranged such that energy emitted from the first heat source member does not interact with the stream of gas and granules; and a second heat source member operative to heat the coating material bonded with the first region.

9. The system of claim 8, wherein the system further comprises a housing member comprising an inner cavity operative to receive a pressurized gas in a first opening and emit an envelope of the pressurized gas from a second opening.

10. The system of claim 9, wherein the system further comprises a controller operative to control a flow rate of the pressurized gas.

11. The system of claim 8, wherein the system further comprises a controller operative to control the first heat source member.

12. The system of claim 8, wherein the system further comprises a controller operative to control the second heat source member.

* * * * *